US010428622B2

(12) United States Patent
Smith et al.

(10) Patent No.: US 10,428,622 B2
(45) Date of Patent: Oct. 1, 2019

(54) FORCE MULTIPLYER USED TO ACTUATE A BALL VALVE

(71) Applicants: James A. Smith, Manvel, TX (US); Larry J. Urban, Santa Fe, TX (US)

(72) Inventors: James A. Smith, Manvel, TX (US); Larry J. Urban, Santa Fe, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 619 days.

(21) Appl. No.: 15/041,878

(22) Filed: Feb. 11, 2016

(65) Prior Publication Data

US 2017/0234109 A1 Aug. 17, 2017

(51) Int. Cl.

| | |
|---|---|
| ***E21B 34/10*** | (2006.01) |
| ***E21B 34/14*** | (2006.01) |
| *E21B 34/00* | (2006.01) |
| *E21B 23/00* | (2006.01) |

(52) U.S. Cl.

CPC ..... *E21B 34/102* (2013.01); *E21B 34/14* (2013.01); *E21B 23/006* (2013.01); *E21B 2034/002* (2013.01); *E21B 2034/007* (2013.01)

(58) Field of Classification Search

CPC ..... E21B 2034/002; E21B 2034/007; E21B 23/006; E21B 34/14; E21B 43/12; E21B 43/126

See application file for complete search history.

(56) References Cited

U.S. PATENT DOCUMENTS 3,993,136 A * 11/1976 Mott ..... E21B 34/101 166/375
4,306,623 A 12/1981 Brooks
4,377,179 A * 3/1983 Giebeler ..... E21B 21/10 137/494
4,406,328 A 9/1983 Brooks
4,446,922 A * 5/1984 Bowyer ..... E21B 34/10 166/322

(Continued)

FOREIGN PATENT DOCUMENTS

| | | |
|---|---|---|
| WO | 9604460 A1 | 2/1996 |
| WO | 2011059845 A2 | 5/2011 |
| WO | 2015061456 A1 | 4/2015 |

OTHER PUBLICATIONS

PCT/US2017/012978—International Search Report and the Written Opinion of the International Searching Authority; dated Apr. 17, 2017; 7 pages.

*Primary Examiner* — Robert E Fuller
*Assistant Examiner* — Christopher J Sebesta
(74) *Attorney, Agent, or Firm* — Cantor Colburn LLP

(57) ABSTRACT

A rotating ball valve assembly includes a rotatable ball element. The rotatable ball element includes a first side portion, a second side portion, and a central passage. One of the first and second side portions includes first and second outwardly projecting pin elements. A sliding sleeve assembly includes a sliding sleeve member having a first guide track with a first force reducing profile associated with the first outwardly projecting pin element and a second guide track having a second force reducing profile associated with the second outwardly projecting pin element. The sliding sleeve member is shiftable relative to the first and second tubular members to selectively pivot the rotatable ball element between an open orientation and a closed orientation.

18 Claims, 6 Drawing Sheets

(56) References Cited

U.S. PATENT DOCUMENTS

| | | | | |
|---|---|---|---|---|
| 4,569,397 | A * | 2/1986 | Brakhage, Jr. | E21B 34/10 166/321 |
| 4,714,116 | A * | 12/1987 | Brunner | E21B 23/006 166/321 |
| 7,329,062 | B2 | 2/2008 | Brand et al. | |
| 8,225,871 | B2 * | 7/2012 | Beall | E21B 34/14 166/332.3 |
| 8,844,653 | B2 | 9/2014 | Deboer | |
| 2012/0018172 | A1 * | 1/2012 | Javed | E21B 34/14 166/382 |
| 2014/0124195 | A1 * | 5/2014 | Tahoun | E21B 21/103 166/250.01 |

* cited by examiner

TORQUE vs BALL ROTATION ANGLE

FORCE MULTIPLYER USED TO ACTUATE A BALL VALVE

BACKGROUND

Downhole operations often include a downhole string that extends from an uphole system into a formation. The uphole system may include a platform, pumps, and other systems that support resource exploration, development, and extraction. In some instances, fluids may be passed from the uphole system into the formation through the downhole string. In other instances, fluid may pass from the formation through the downhole string to the uphole system. In order to control fluid flow, one or more valves may be incorporated into the downhole string. Valves in the downhole string may be operated by tools originating at the uphole system. Valves may take on many forms.

Ball valves are commonly used in the downhole string to control flow. In addition to having good sealing characteristics, ball valves supply unrestricted flow when fully opened. Often high forces may be required to shift a ball between an open orientation and a closed orientation. The high force is often needed to overcome obstacles to movement such as differential pressures, sand granules and the like. Systems and methods to overcome the foregoing drawbacks are well received in the art.

SUMMARY

A rotating ball valve assembly includes a first tubular member having a first end portion defining a first valve seat, and a second tubular member having a second end portion defining a second valve seat. The second valve seat is spaced from the first valve seat by a gap. A rotatable ball element is arranged in the gap. The rotatable ball element includes a body having a first side portion, a second side portion, and a central passage having a first opening and a second opening. At least one of the first and second side portions includes first and second outwardly projecting pin elements. A sliding sleeve assembly extends across the gap. The sliding sleeve assembly includes a sliding sleeve member having a first guide track with a first force reducing profile associated with the first outwardly projecting pin element and a second guide track having a second force reducing profile associated with the second outwardly projecting pin element. The sliding sleeve member is shiftable relative to the first and second tubular members to selectively pivot the rotatable ball element between an open orientation, wherein the central passage is exposed to the first and second tubular members and a closed orientation wherein the central passage is fluidically isolated from the first and second tubular members.

A resource exploration system includes an uphole system, and a downhole system including a downhole string operatively connected to the uphole system. The downhole string includes a rotating ball valve assembly. The rotating ball valve assembly includes a first tubular member having a first end portion defining a first valve seat, and a second tubular member having a second end portion defining a second valve seat. The second valve seat is spaced from the first valve seat by a gap. A rotatable ball element is arranged in the gap. The rotatable ball element includes a body having a first side portion, a second side portion, and a central passage having a first opening and a second opening. At least one of the first and second side portions includes first and second outwardly projecting pin elements. A sliding sleeve assembly extends across the gap. The sliding sleeve assembly includes a sliding sleeve member having a first guide track with a first force reducing profile associated with the first outwardly projecting pin element and a second guide track having a second force reducing profile associated with the second outwardly projecting pin element. The sliding sleeve member is shiftable relative to the first and second tubular members to selectively pivot the rotatable ball element between an open orientation, wherein the central passage is exposed to the first and second tubular members and a closed orientation wherein the central passage is fluidically isolated from the first and second tubular members.

BRIEF DESCRIPTION OF THE DRAWINGS

Referring now to the drawings wherein like elements are numbered alike in the several Figures.

DETAILED DESCRIPTION

Figure 1:
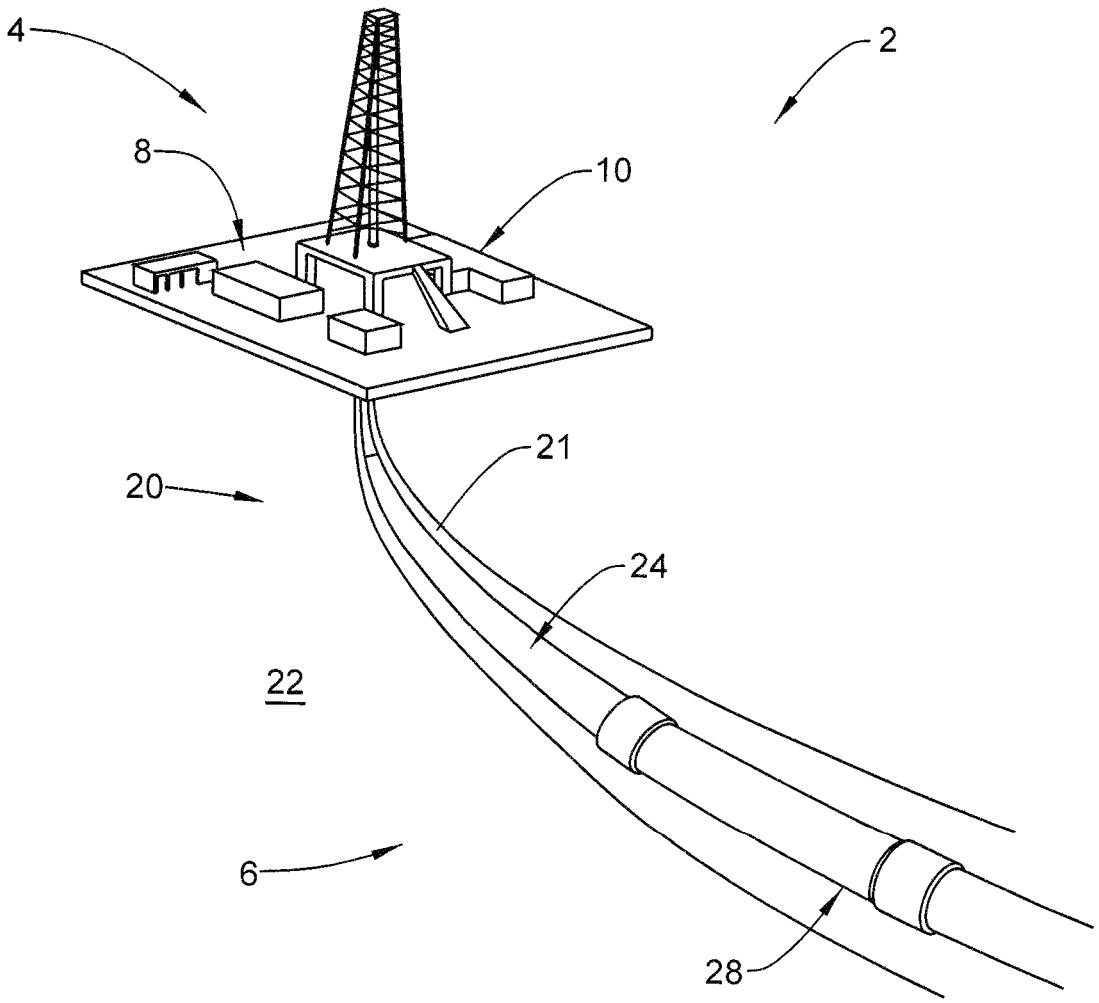
FIG. 1 depicts an uphole system operatively connected to a downhole string having a rotating ball valve member, in accordance with an exemplary embodiment.

A resource exploration system, in accordance with an exemplary embodiment, is indicated generally at 2, in FIG. 1. Resource exploration system 2 should be understood to include well drilling operations, resource extraction and recovery, $CO_2$ sequestration, and the like. Resource exploration system 2 may include an uphole system 4 operatively connected to a downhole system 6. Uphole system 4 may include pumps 8 that aid in completion and/or extraction processes as well as fluid storage 10. Fluid storage 10 may contain a gravel pack fluid or slurry (not shown) that is introduced into downhole system 6.

Figure 2:
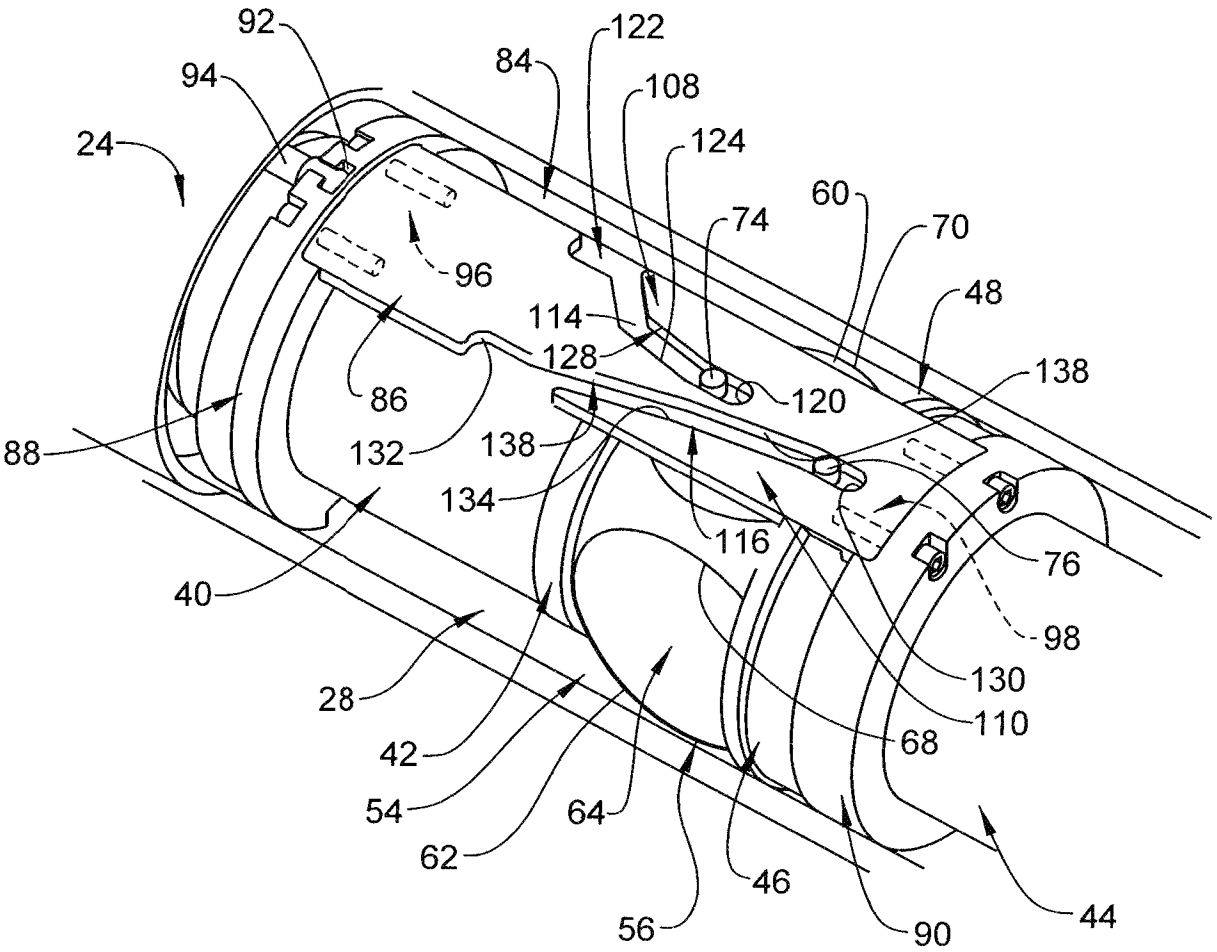
FIG. 2 depicts the rotating ball valve assembly of FIG. 1 having a rotatable ball element, in accordance with an aspect of an exemplary embodiment, in a closed orientation.

Downhole system 6 may include a downhole string 20 that is extended into a wellbore 21 formed in formation 22. Downhole string 20 may include a number of connected downhole tools or tubulars 24. One of tubulars 24 may include a rotating ball valve assembly 28. In accordance with an exemplary embodiment shown in FIGS. 2-3, rotating ball valve assembly 28 includes a first tubular member 40 defining a first valve seat 42 spaced from a second tubular member 44 defining a second valve seat 46 by a gap 48.

Figure 3:
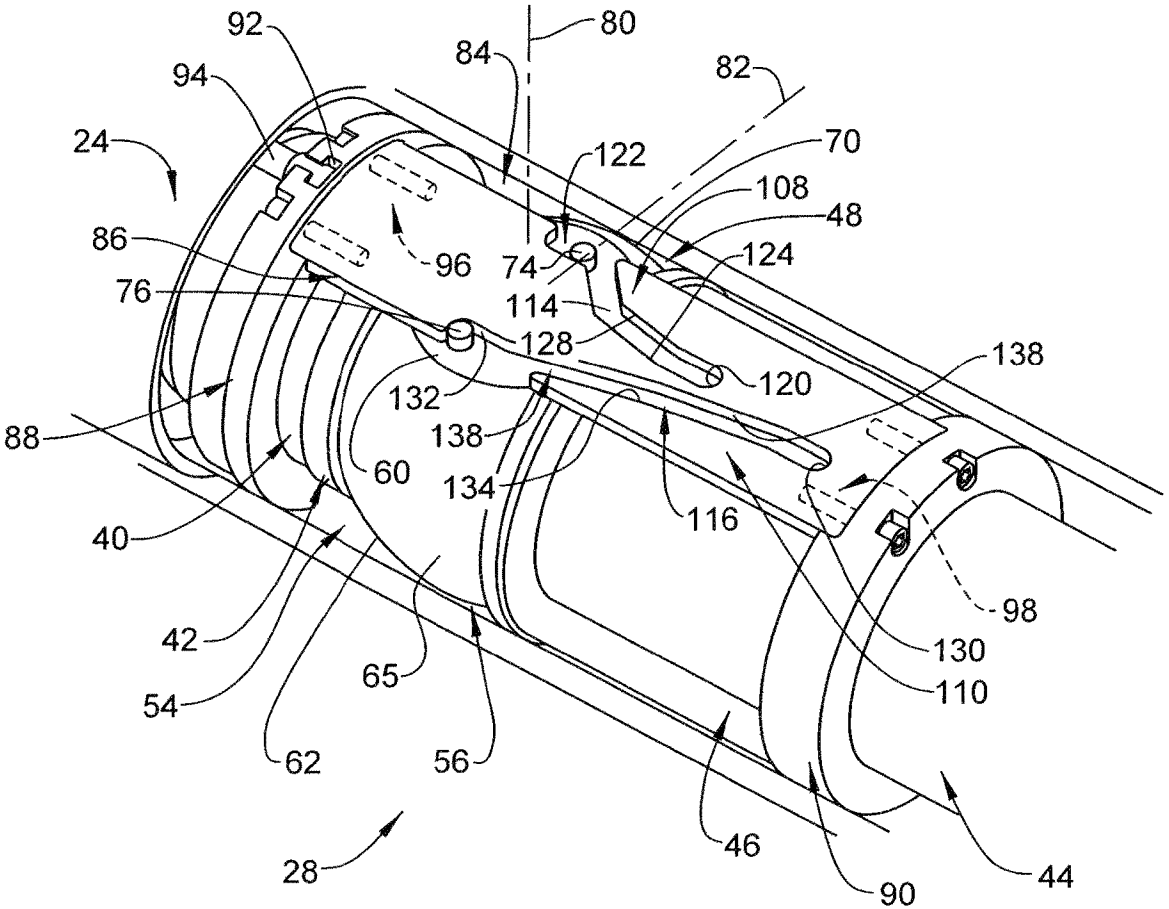
FIG. 3 depicts the rotatable ball valve element of FIG. 2 in an open orientation.

In accordance with an aspect of an exemplary embodiment, rotating ball valve assembly 28 includes a rotating ball element 54 having a body 56. Body 56 includes a first side portion 60, a second side portion 62 and a central passage 64 having first and second opposing openings 68 and 70. Rotating ball element also includes a third side portion 65 (FIG. 3) and a fourth side portion (not shown). First side portion 60 includes a first outwardly projecting pin element 74 and a second outwardly projecting pin element 76. Although not shown, it should be understood that second side portion 62 may also include outwardly projecting pin elements. As will be detailed more fully below, rotating ball element 54 is rotatable about an axis of rotation 80 between a closed orientation (FIG. 2) and an open orientation (FIG. 3). Further, first and second outwardly projecting pin elements 74 and 76 may define a pin axis 82 that extends substantially perpendicularly relative to axis of rotation 80 and substantially parallel to first and second opposing openings 68 and 70. Of course, it should be understood, that first second pin elements 74 and 76 may be arranged in various orientations. In the closed orientation, fluid flow between first and second tubular members 40 and 44 is prevented. In the open orientation, first opening 68 registers with first valve seat 42 and second opposing opening 70 registers with second valve seat 46 allowing fluid to pass through central passage 64 between first and second tubular members 40 and 44.

In further accordance with an exemplary aspect, rotating valve ball assembly 28 includes a sliding sleeve assembly 84 having a sliding sleeve member 86 supported between a first ring member 88 and a second ring member 90. First ring member 88 is slidingly disposed on first tubular member 40 and second ring member 90 is slidingly disposed on second tubular member 44. In the exemplary aspect shown, first ring member 88 includes a tool receiving portion 92 receptive of an actuation tool member 94 that extends to uphole system 4. Sliding sleeve member 86 is operatively connected to first ring member 88 through one or more mechanical fasteners 96 and to second ring member through one or more mechanical fasteners 98. At this point, it should be understood, that rotating ball valve assembly 28 may include a second sliding sleeve member (not shown) that also interacts with rotating ball element 54.

In accordance with an exemplary embodiment, sliding sleeve member 86 includes a first guide tract 108 and a second guide track 110. First and second guide tracks 108 and 110 extend between first ring member 88 and second ring member 90 along sliding sleeve member 86. First guide track 108 includes a first force reducing profile 114 and second guide track 110 includes a second force reducing profile 116. First and second force reducing profiles 114 and 116 lower an amount of force required to be input to first ring member 88 in order to shift rotating ball element 54 between the open and closed orientations.

First guide track 108 includes a first or closed end 120, a second or opened end 122, and a passage 124, defining first force reducing profile 114, extending therebetween. First guide track 108 is receptive of first outwardly projecting pin element 74. Passage 124 includes a first wedge section 128 arranged proximate to closed end 120. In accordance with an aspect of an exemplary embodiment, first wedge section 128 may extend at an angle of approximately 10° relative to a longitudinal axis (not separately labeled) of rotatable ball valve 28. Of course, it should be understood that the particular angle may vary depending upon desired actuation forces. For example, first wedge section 128 may extend at an angle of between about 1° and about 45° relative to the longitudinal axis of rotatable ball valve 28.

Similarly, second guide track 110 includes a first or closed end portion 130, a second or opened end portion 132, and a passage portion 134, defining second force reducing profile 116, extending therebetween. Second guide track 110 is receptive of second outwardly projecting pin element 76. Passage portion 134 includes a second wedge section 138 arranged proximate to closed end portion 130. In accordance with another aspect of an exemplary embodiment, second wedge section 138 may extend at an angle of approximately 10° relative to the longitudinal axis of rotatable ball valve 28. Of course, it should be understood that the particular angle may vary depending upon desired actuation forces. For example, second wedge section 128 may extend at an angle of between about 1° and about 45° relative to the longitudinal axis of rotatable ball valve 28.

As will be detailed more fully below, first and second wedge sections 128 and 138 promote a transition of first and second outwardly projecting pin elements 74 and 76 from respective ones of closed end 120 and closed end portion 130 toward opened end 122 and opened end portion 132 with a reduced force input through first ring member 88. More specifically, first and second wedge sections 128 and 138 enable the use of reduced forces to shift rotating ball element 54 from the closed orientation when rotating valve assembly 28 is exposed to differential pressures at first and second tubular members 40 and 44. Additionally, while not shown, it should be understood that sliding sleeve member 86 may include one or more outwardly extending bosses that interact with rotating ball element 54 to aid in rotation and/or locking in the open or closed positions.

Figure 4:
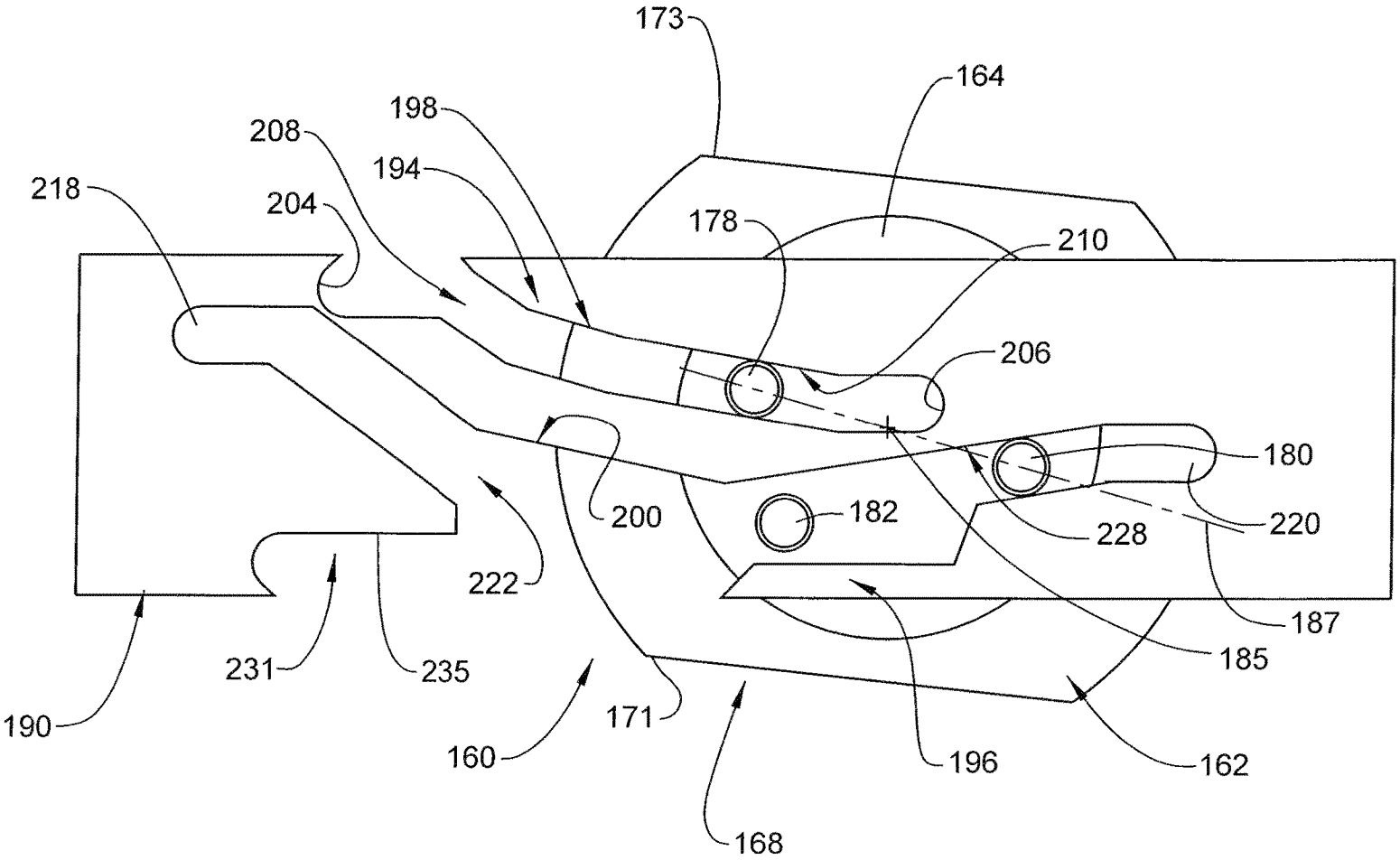
FIG. 4 depicts the rotating ball valve assembly having a rotatable ball element in a closed orientation, in accordance with another aspect of an exemplary embodiment.
Figure 5:
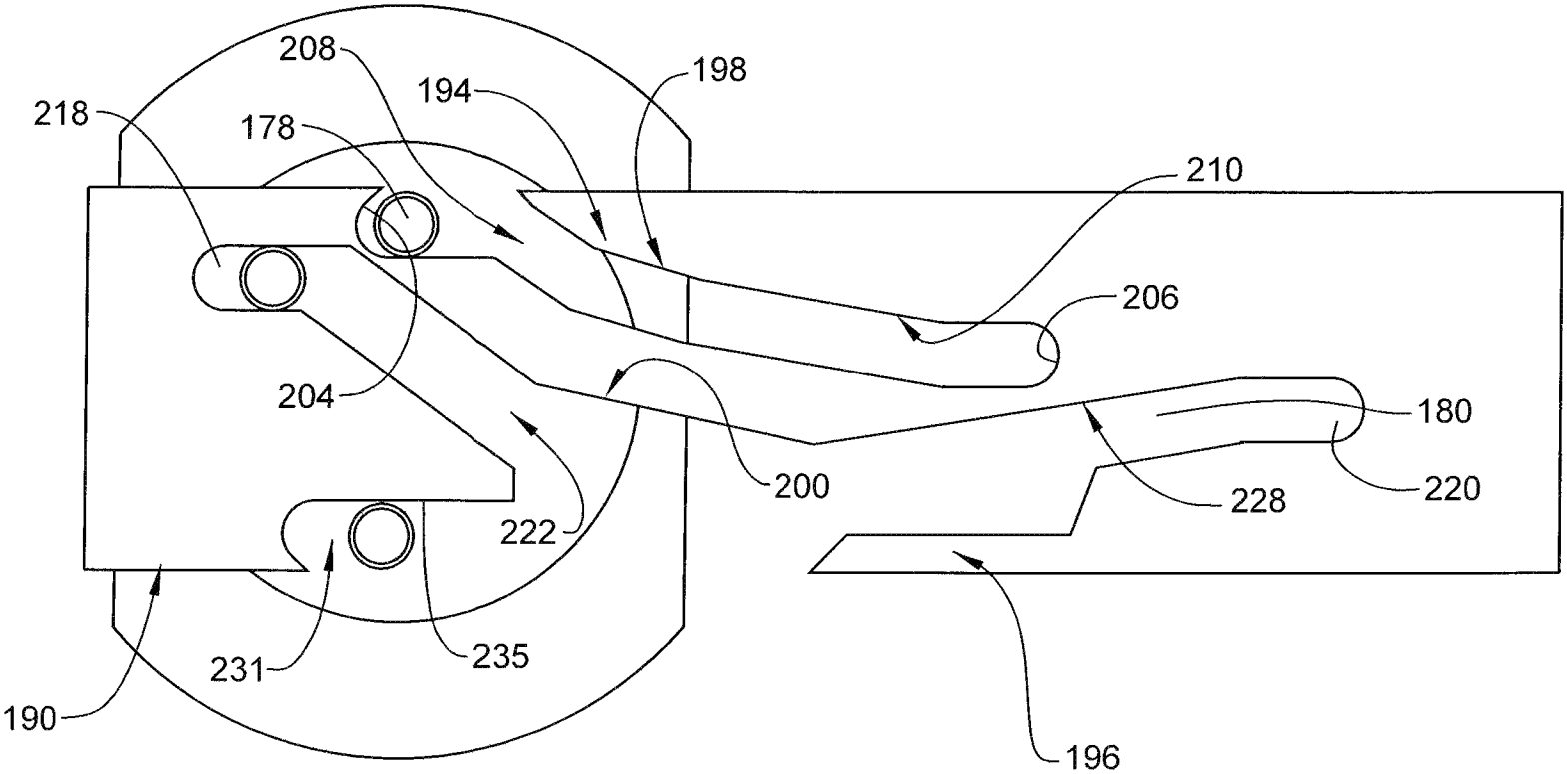
FIG. 5 depicts the rotating ball valve assembly of FIG. 4 in an open orientation.

Reference will now follow to FIGS. 4-5 in describing a rotating ball element 160 in accordance with another aspect of an exemplary embodiment. Rotating ball element 160 includes a body 162 including a first side portion 164, a second side portion (not shown) and a central passage 168 having first and second opposing openings 171 and 173. First side portion 164 includes a first outwardly projecting pin element 178, a second outwardly projecting pin element 180, and a third outwardly projecting pin element 182. Although not shown, it should be understood that the second side portion may also include outwardly projecting pin elements. As will be detailed more fully below, rotating ball element 160 is rotatable about an axis of rotation 185 between a closed orientation (FIG. 4) and an open orientation (FIG. 5). Further, first and second outwardly projecting pin elements 178 and 180 may define a pin axis 187 that extends substantially perpendicularly relative to axis of rotation 185 and substantially parallel to first and second opposing openings 171 and 173. Of course, it should be understood, that first second pin elements 178 and 180 may be arranged in various orientations. In the closed orientation, fluid flow between first and second tubular members 40 and 44 is prevented. In the open orientation, first opposing opening 171 registers with first valve seat 42 and second opposing opening 173 registers with second valve seat 46 allowing fluid to pass through central passage 168 between first and second tubular members 40 and 44.

In further accordance with an exemplary aspect, rotating ball element 160 interacts with a sliding sleeve member 190 that may be supported between first ring member 88 and second ring member 90. At this point, it should be understood, that rotating ball element may also interact with a second sliding sleeve member (not shown). In accordance with an exemplary embodiment, sliding sleeve member 190 includes a first guide tract 194 and a second guide track 196. First and second guide tracks 194 and 196 extend between first ring member 88 and second ring member 90 along sliding sleeve member 190. First guide track 194 includes a first force reducing profile 198 and second guide track 196 includes a second force reducing profile 200. First and second force reducing profiles 198 and 200 lower an amount of force required to be input to first ring member 88 in order to shift rotating ball element 160 between the open and closed orientations.

First guide track 194 includes a first or opened end 204, a second or closed end 206, and a passage 208, defining first force reducing profile 198, extending therebetween. First guide track 194 is receptive of first outwardly projecting pin element 178. Passage 208 includes a first wedge section 210 arranged proximate to closed end 206. First wedge section 210 may extend at an angle of approximately 10° relative to a longitudinal axis of rotatable ball valve 28. Of course, it should be understood that the particular angle may vary depending upon desired actuation forces. For example, first wedge section 210 may extend at an angle of between about 1° and about 45° relative to the longitudinal axis of rotatable ball valve 28.

Similarly, second guide track 196 includes a first or opened end portion 218, a second or closed end portion 220, and a passage portion 222, defining second force reducing profile 200, extending therebetween. Passage portion 222 includes a second wedge section 228 arranged proximate to closed end portion 220. Second wedge section 228 may extend at an angle of approximately 10° relative to a longitudinal axis of rotatable ball valve 28. Of course, it should be understood that the particular angle may vary depending upon desired actuation forces. For example, second wedge section 228 may extend at an angle of between about 1° and about 45° relative to the longitudinal axis of rotatable ball valve 28. In accordance with an aspect of an exemplary embodiment, second guide track 196 is receptive of second outwardly projecting pin element 180 and third outwardly projecting pin element 182. More specifically, second guide track 196 includes a branch section 231 that receives third outwardly projecting pin element 182.

As will be detailed more fully below, first and second wedge sections 210 and 228 promote a transition of first and second pin elements 178 and 180 from respective ones of closed end 206 and closed end portion 220 toward opened end 204 and opened end portion 218 with a reduced force input through first ring member 88. More specifically, first and second wedge sections 210 and 228 enable the use of reduced forces to shift rotating ball element 160 from the closed orientation when rotating valve assembly 28 is exposed to differential pressures at first and second tubular members 40 and 44. A branch profile 235 on branch section 231 promotes a more complete closing of rotating valve assembly 28. Branch profile 235 may also include a locking region (not shown) that promotes a locking of rotating ball element 160 in the closed orientation. Further, it should be understood that opened end portion 218 may also include a locking profile that maintains rotating ball element 160 in the open configuration. Additionally, while not shown, it should be understood that sliding sleeve member 190 may include one or more outwardly extending bosses that interact with rotating ball element 160 to aid in rotation and/or locking in the open or closed positions.

Figure 6:
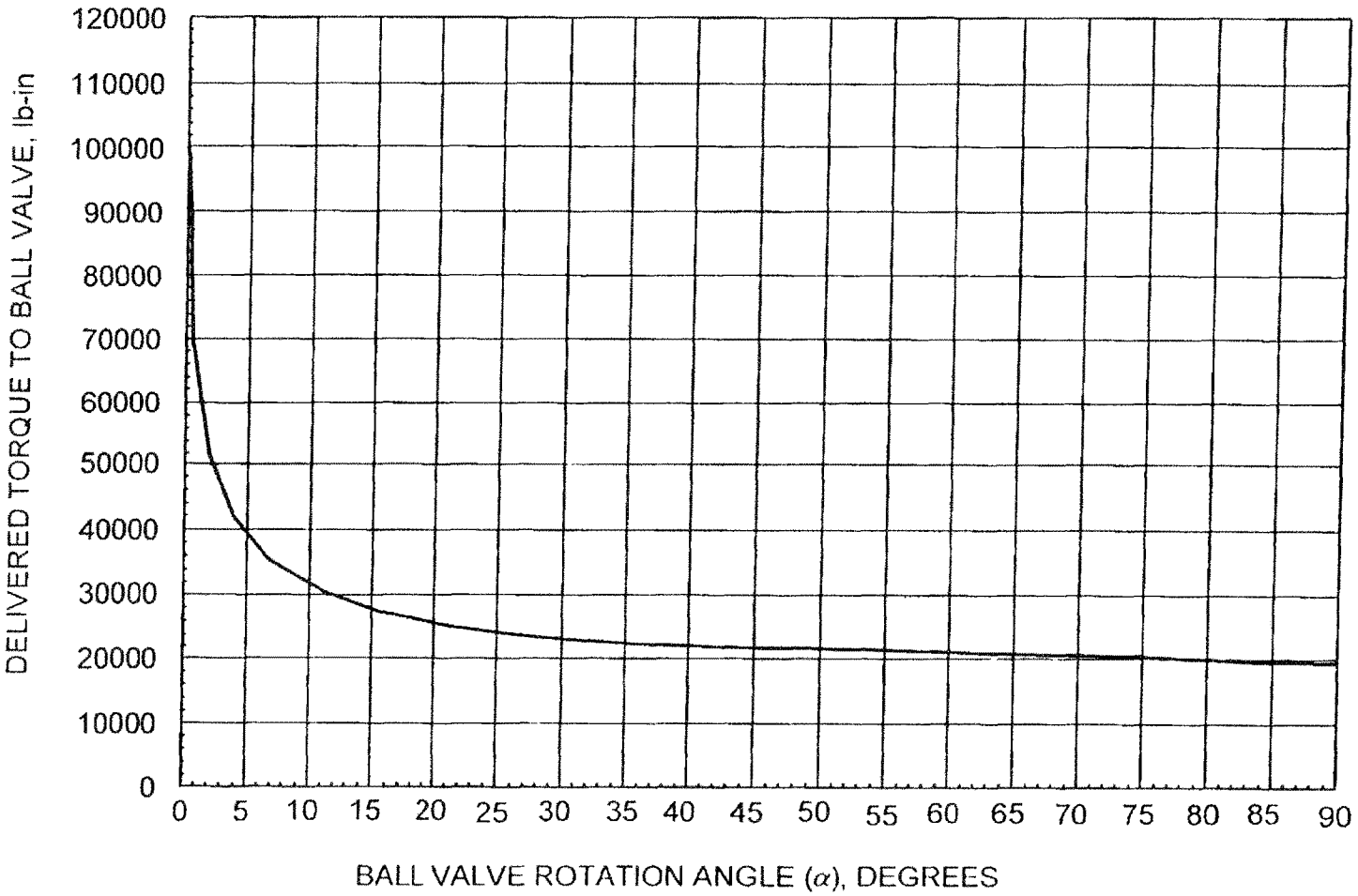
FIG. 6 depicts a graph illustrating a force curve of applied force for shifting the rotatable ball element between open and closed configurations.

In accordance with an aspect of an exemplary embodiment, shifting rotating valve assembly 28 from a closed orientation to an open orientation requires an initial high force input as shown in FIG. 6. After a very short period of rotation, approximately, 4°, the amount of force drops precipitously; and, at about 35°, the force becomes substantially linear. Thus, in contrast to prior art valves, in which opening forces start high, drop, and then increase, the rotating ball valve assembly of the present invention facilitates a greatly reduced force profile that leads to lower forces being applied from uphole.

Set forth below are some embodiments of the foregoing disclosure:

Embodiment 1

A rotating ball valve assembly comprising: a first tubular member having a first end portion defining a first valve seat; a second tubular member having a second end portion defining a second valve seat, the second valve seat being spaced from the first valve seat by a gap; a rotatable ball element arranged in the gap, the ball element including a body having a first side portion, a second side portion, and a central passage having a first opening and a second opening, at least one of the first and second side portions including first and second outwardly projecting pin elements; and a sliding sleeve assembly extending across the gap, the sliding sleeve assembly including a sliding sleeve member including a first guide track having a first force reducing profile associated with the first outwardly projecting pin element and a second guide track having a second force reducing profile associated with the second outwardly projecting pin element, the sliding sleeve member being shiftable relative to the first and second tubular members to selectively pivot the rotatable ball element between an open orientation, wherein the central passage is exposed to the first and second tubular members and a closed orientation wherein the central passage is fluidically isolated from the first and second tubular members.

Embodiment 2

The rotating ball valve assembly according to embodiment 1, wherein the sliding sleeve member includes a first ring member encircling the first tubular, a second ring member encircling the second tubular and a plate member extending therebetween, the first and second guide tracks being formed in the plate member.

Embodiment 3

The rotating ball valve assembly according to embodiment 2, further comprising: a tool member operatively connected to the first ring member, the tool member extending uphole from the sliding sleeve.

Embodiment 4

The rotating ball valve assembly according to embodiment 1, wherein the first guide track includes an opened end, a closed end and a passage defined by the first force reducing profile extending therebetween, the first outwardly projecting pin element being positioned at the opened end when the rotatable ball element is in the open orientation and at the closed end when the rotatable ball element is in the closed orientation.

Embodiment 5

The rotating ball valve assembly according to embodiment 4, wherein the first force reducing profile includes a first wedge section arranged proximate to the closed end.

Embodiment 6

The rotating ball valve assembly according to embodiment 5, wherein the second guide track includes an opened end portion, a closed end portion and a passage portion defined by the second force reducing profile extending therebetween, the second outwardly projecting pin element being positioned at the opened end when the rotatable ball element is in the open orientation and at the closed end when the rotatable ball element is in the closed orientation.

Embodiment 7

The rotating ball valve assembly according to embodiment 6, wherein the second force reducing profile includes a second wedge section arranged proximate to the closed end portion.

Embodiment 8

The rotating ball valve assembly according to embodiment 1, wherein the rotatable ball element includes an axis of rotation extending through the first and second side portions and a pin axis extending substantially perpendicularly relative to the axis of rotation and substantially parallel to the first and second openings, each of the first and second extending pin elements being arranged along the pin axis.

Embodiment 9

The rotating ball valve assembly according to embodiment 8, wherein the rotatable ball element includes a third outwardly projecting pin element projecting from the one of the at least one first and second side portions.

Embodiment 10

The rotating ball valve assembly according to embodiment 9, wherein one of the first and second guide tracks includes a branch section receptive of the third outwardly projecting pin element.

Embodiment 11

A resource exploration system comprising: an uphole system; and a downhole system including a downhole string operatively connected to the uphole system, the downhole string includes a rotating ball valve assembly comprising: a first tubular member having a first end portion defining a first valve seat; a second tubular member having a second end portion defining a second valve seat, the second valve seat being spaced from the first valve seat by a gap; a rotatable ball element arranged in the gap, the ball element including a body having a first side portion, a second side portion, and a central passage having a first opening and a second opening, at least one of the first and second side portions including first and second outwardly projecting pin elements; and a sliding sleeve assembly extending across the gap, the sliding sleeve assembly including a sliding sleeve member including a first guide track having a first force reducing profile associated with the first outwardly projecting pin element and a second guide track having a second force reducing profile associated with the second outwardly projecting pin element, the sliding sleeve member being shiftable relative to the first and second tubular members to selectively pivot the rotatable ball element between an open orientation, wherein the central passage is exposed to the first and second tubular members and a closed orientation wherein the central passage is fluidically isolated from the first and second tubular members.

Embodiment 12

The resource exploration system according to embodiment 11, wherein the sliding sleeve member includes a first ring member encircling the first tubular, a second ring member encircling the second tubular and a plate member extending therebetween, the first and second guide tracks being formed in the plate member.

Embodiment 13

The resource exploration system according to embodiment 12, further comprising: a tool member operatively connected to the first ring member, the tool member extending uphole from the sliding sleeve.

Embodiment 14

The resource exploration system according to embodiment 11, wherein the first guide track includes an opened end, a closed end and a passage defined by the first force reducing profile extending therebetween, the first outwardly projecting pin element being positioned at the opened end when the rotatable ball element is in the open orientation and at the closed end when the rotatable ball element is in the closed orientation.

Embodiment 15

The resource exploration system according to embodiment 14, wherein the first force reducing profile includes a first wedge section arranged proximate to the closed end.

Embodiment 16

The resource exploration system according to embodiment 15, wherein the second guide track includes an opened end portion, a closed end portion and a passage portion defined by the second force reducing profile extending therebetween, the second outwardly projecting pin element being positioned at the opened end when the rotatable ball element is in the open orientation and at the closed end when the rotatable ball element is in the closed orientation.

Embodiment 17

The resource exploration system according to embodiment 16, wherein the second force reducing profile includes a second wedge section arranged proximate to the closed end portion.

Embodiment 18

The resource exploration system according to embodiment 11, wherein the rotatable ball element includes an axis of rotation extending through the first and second side portions and a pin axis extending substantially perpendicularly relative to the axis of rotation and substantially parallel to the first and second openings, each of the first and second extending pin elements being arranged along the pin axis.

Embodiment 19

The resource exploration system according to embodiment 18, wherein the rotatable ball element includes a third outwardly projecting pin element projecting from the one of the at least one first and second side portions.

Embodiment 20

The resource exploration system according to embodiment 19, wherein one of the first and second guide tracks includes a branch section receptive of the third outwardly projecting pin element.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

The term "about" is intended to include the degree of error associated with measurement of the particular quantity based upon the equipment available at the time of filing the application. For example, "about" can include a range of ±8% or 5%, or 2% of a given value.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A rotating ball valve assembly comprising:

a first tubular member having a first end portion defining a first valve seat;

a second tubular member having a second end portion defining a second valve seat, the second valve seat being spaced from the first valve seat by a gap;

a rotatable ball element arranged in the gap, the ball element including a body having a first side portion, a second side portion, a central passage having a first opening and a second opening, a first outwardly projecting pin extending from one of the first side portion and the second side portion and a second outwardly projecting pin extending from the one of the first side portion and the second side portion; and a sliding sleeve assembly extending across the gap, the sliding sleeve assembly including a sliding sleeve member including a first guide track hating a first force reducing profile engagable with the first outwardly projecting pin element and a second guide track having a second force reducing profile engagable with the second outwardly projecting pin element, the sliding sleeve member being shiftable relative to the first and second tubular members to selectively pivot the rotatable ball element between an open orientation, wherein the central passage is exposed to the first and second tubular members and a closed orientation wherein the central passage is fluidically isolated from the first and second tubular members;

wherein the rotatable ball element includes a third outwardly projecting pin element projecting from the one of the at least one first and second side portions.

2. The rotating ball valve assembly according to claim 1, wherein the sliding sleeve member includes a first ring member encircling the first tubular, a second ring member encircling the second tubular and a plate member extending therebetween, the first and second guide tracks being formed in the plate member.

3. The rotating ball valve assembly according to claim 2, further comprising: a tool member operatively connected to the first ring member, the tool member extending uphole from the sliding sleeve.

4. The rotating ball valve assembly according to claim 1, wherein the first guide track includes an opened end, a closed end and a passage defined by the first force reducing profile extending therebetween, the first outwardly projecting pin element being positioned at the opened end when the rotatable ball element is in the open orientation and at the closed end when the rotatable ball element is in the closed orientation.

5. The rotating ball valve assembly according to claim 4, wherein the first force reducing profile includes a first wedge section arranged proximate to the closed end.

6. The rotating ball valve assembly according to claim 5, wherein the second guide track includes an opened end portion, a closed end portion and a passage portion defined by the second force reducing profile extending therebetween, the second outwardly projecting pin element being positioned at the opened end when the rotatable ball element is in the open orientation and at the closed end when the rotatable ball element is in the closed orientation.

7. The rotating ball valve assembly according to claim 6, wherein the second force reducing profile includes a second wedge section arranged proximate to the closed end portion.

8. The rotating ball valve assembly according to claim 1, wherein the rotatable ball element includes an axis of rotation extending through the first and second side portions and a pin axis extending substantially perpendicularly relative to the axis of rotation and substantially parallel to the first and second openings, each of the first and second extending pin elements being arranged along the pin axis.

9. The rotating ball valve assembly according to claim 1, wherein one of the first and second guide tracks includes a branch section receptive of the third outwardly projecting pin element.

10. A resource exploration system comprising:

an uphole system; and a downhole system including a downhole string operatively connected to the uphole system, the downhole string includes a rotating ball valve assembly comprising:

a first tubular member having a first end portion defining a first valve seat;

a second tubular member having a second end portion defining a second valve seat, the second valve seat being spaced from the first valve seat by a gap;

a rotatable ball element arranged in the gap, the ball element including a body having a first side portion, a second side portion, a central passage having a first opening and a second opening, a first outwardly projecting pin extending from one of the first side portion and the second side portion and a second outwardly projecting pin extending from the one of the first side portion and the second side portion, and a sliding sleeve assembly extending across the gap, the sliding sleeve assembly including a sliding sleeve member including a first guide track having a first force reducing profile engagable with the first outwardly projecting pin element and a second guide track having a second force reducing profile engagable with the second outwardly projecting pin element, the sliding sleeve member being shiftable relative to the first and second tubular members to selectively pivot the rotatable ball element between an open orientation, wherein the central passage is exposed to the first and second tubular members and a closed orientation wherein the central passage is fluidically isolated from the first and second tubular members, wherein the rotatable ball element includes a third outwardly projecting pin element projecting from the one of the at least one first and second side portions.

11. The resource exploration system according to claim 10, wherein the sliding sleeve member includes a first ring member encircling the first tubular, a second ring member encircling the second tubular and a plate member extending therebetween, the first and second guide tracks being formed in the plate member.

12. The resource exploration system according to claim 11, further comprising: a tool member operatively connected to the first ring member, the tool member extending uphole from the sliding sleeve.

13. The resource exploration system according to claim 10, wherein the first guide track includes an opened end, a closed end and a passage defined by the first force reducing profile extending therebetween, the first outwardly projecting pin element being positioned at the opened end when the rotatable ball element is in the open orientation and at the closed end when the rotatable ball element is in the closed orientation.

14. The resource exploration system according to claim 13, wherein the first force reducing profile includes a first wedge section arranged proximate to the closed end.

15. The resource exploration system according to claim 14, wherein the second guide track includes an opened end portion, a closed end portion and a passage portion defined by the second force reducing profile extending therebetween, the second outwardly projecting pin element being positioned at the opened end when the rotatable ball element is in the open orientation and at the closed end when the rotatable ball element is in the closed orientation.

16. The resource exploration system according to claim 15, wherein the second force reducing profile includes a second wedge section arranged proximate to the closed end portion.

17. The resource exploration system according to claim 10, wherein the rotatable ball element includes an axis of rotation extending through the first and second side portions and a pin axis extending substantially perpendicularly relative to the axis of rotation and substantially parallel to the first and second openings, each of the first and second extending pin elements being arranged along the pin axis.

18. The resource exploration system according to claim 10, wherein one of the first and second guide tracks includes a branch section receptive of the third outwardly projecting pin element.

* * * * *